United States Patent [19]

Pascale

[11] Patent Number: 4,919,221

[45] Date of Patent: Apr. 24, 1990

[54] IMPACT DRILL BIT ASSEMBLY AND REPLACEABLE PARTS THEREOF

[75] Inventor: Jack H. Pascale, Bloomsbury, N.J.

[73] Assignee: Numa Tool Company, Thompson, Conn.

[21] Appl. No.: 333,903

[22] Filed: Apr. 6, 1989

[51] Int. Cl.[5] ..... E21B 10/52

[52] U.S. Cl. ..... 175/415; 403/359; 173/132

[58] Field of Search ..... 375/306, 323, 415, 416; 403/348, 349, 359; 173/17, 134, 136

[56] References Cited

U.S. PATENT DOCUMENTS

| | | | |
|---|---|---|---|
| Re. 30,952 | 6/1982 | White | 175/415 X |
| 1,785,990 | 12/1930 | Welsh . | |
| 2,145,466 | 1/1939 | Urschel | 175/415 |
| 2,371,498 | 3/1945 | Boynton . | |
| 2,802,642 | 5/1955 | Feucht . | |
| 2,869,907 | 1/1959 | Deliso | 403/359 |
| 2,995,962 | 5/1948 | Letts . | |
| 3,222,772 | 12/1965 | Leyner | 403/359 X |
| 4,043,409 | 8/1977 | Walter | 175/321 |
| 4,083,415 | 4/1978 | Kita et al. | 175/415 X |
| 4,190,125 | 2/1980 | Emmerich et al. | 175/410 |
| 4,252,202 | 2/1981 | Purser, Sr. | 175/412 |
| 4,454,922 | 6/1984 | Jamison et al. | 403/359 X |

FOREIGN PATENT DOCUMENTS

| | | | |
|---|---|---|---|
| 2127463 | 4/1984 | United Kingdom | 175/415 |

*Primary Examiner*—William P. Neuder

*Attorney, Agent, or Firm*—Chilton, Alix & Van Kirk

[57] ABSTRACT

A downhole drill bit having an elongated male drive shank, a separate female impact head mounted on the drive shank, the drive shank and head having cooperating external and internal, head drive splines extending helically in one angular direction to urge the drive shank and head together during impact drilling, the head drive splines having a width and spacing for inserting and then rotating the head on the shank, and elongated key inserts between the head drive splines to form therewith a head drive coupling, the head having an annulus and the drive shank having a circular arrangement of locking lugs receivable within the annulus for locking the head against axial withdrawal from the shank.

22 Claims, 3 Drawing Sheets

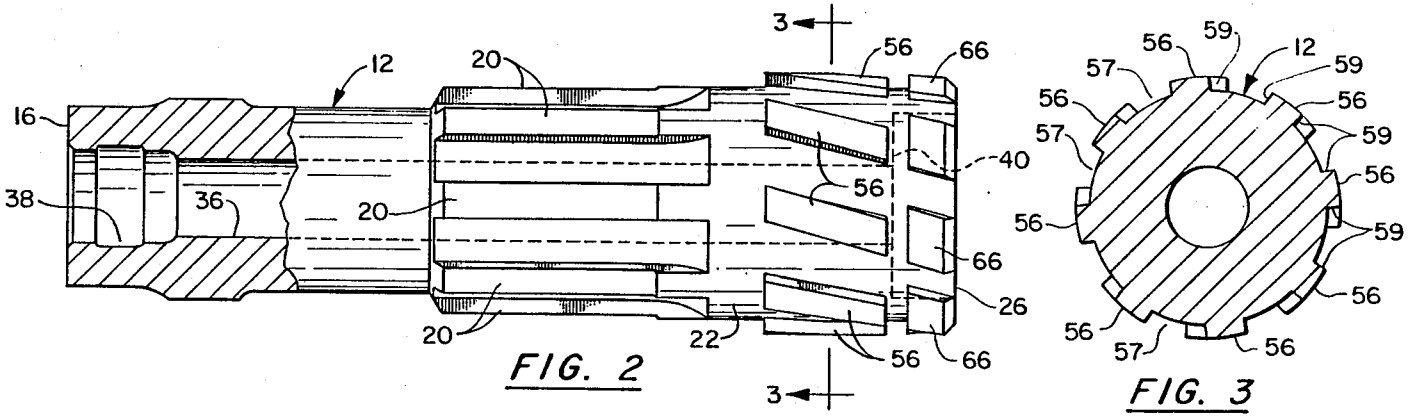
FIG. 2
FIG. 3
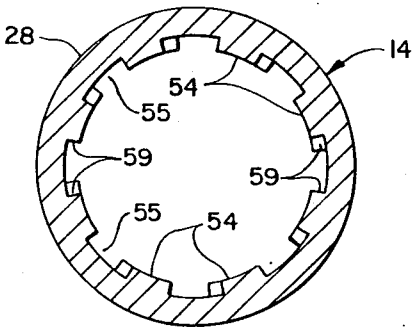
FIG. 5
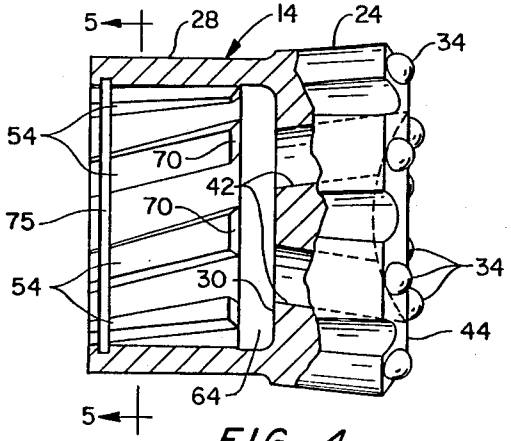
FIG. 4

IMPACT DRILL BIT ASSEMBLY AND REPLACEABLE PARTS THEREOF

SUMMARY OF THE INVENTION

The present invention relates generally to impact drills and more particularly to a new and improved impact bit assembly having notable utility with downhole impact drills and to a new and improved replaceable, impact drive shank and impact head of the bit assembly.

It is a prinical aim of the present invention to provide a new and improved replaceable impact head for downhole impact drill bits.

It is another aim of the present invention to provide a new and improved bit assembly for downhole impact drills, having a male drive shank with an inner end adapted to be mounted in a downhole hammer of the drill in a conventional manner and a female head adapted to be readily mounted on and removed from the outer end of the drive shank.

It is a further aim of the present invention to provide in an impact bit assembly of the type having a separate male drive shank and female head, a new and improved head coupling for permitting ready removal of the head from the drive shank for ready replacement of the head and/or drive shank as required.

It is a further aim of the present invention to provide a new and improved impact head and new and improved impact drive shank of the type described which provide for impact drilling in a conventional manner and which permits ready removal and replacement of the impact head and/or impact drive shank with minimum equipment down time.

It is a further aim of the present invention to provide a new and improved impact head and new and improved impact drive shank of the type described having an economical design and low replacement cost.

Other objects will be in part obvious and in part pointed out more in detail hereinafter.

A better understanding of the invention will be obtained from the following detailed description and accompanying drawings of an impact bit assembly incorporating a preferred embodiment of the invention.

BRIEF DESCRIPTION OF THE DRAWINGS

In the drawings:

FIG. 2 is a side view, partly broken away and partly in section, of a male drive shank of the bit of FIG. 1;

FIG. 3 is a transverse section view, partly in section, of the drive shank taken generally along line 3—3 of FIG. 2;

FIG. 4 is a side view, partly broken away and partly in section, of a female impact head of the bit of FIG. 1;

FIG. 5 is a transverse section view, partly in section, of the impact head taken generally along line 5—5 of FIG. 4; FIGS, 6 and 8 are partial side views, each partly broken away and FIG. 8 shown partly in section, of the drive shank and impact head, showing respectively, the head partly and fully installed on the shank;

DESCRIPTION OF PREFERRED EMBODIMENT

Figure 1:
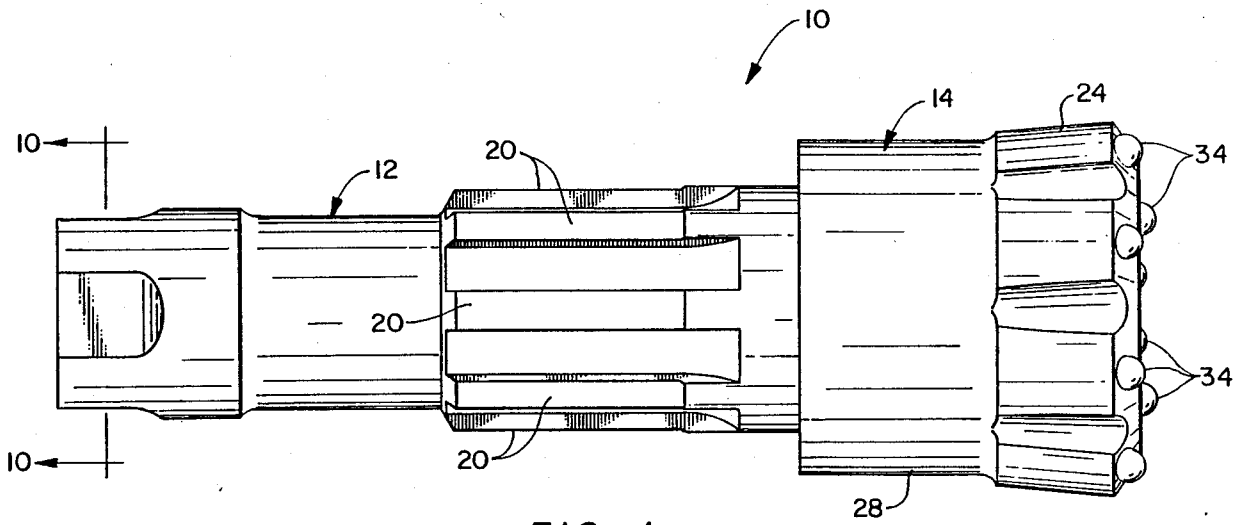
FIG. 1 is a side view of a downhole hammer bit incorporating a preferred embodiment of the present invention.
Figure 11:
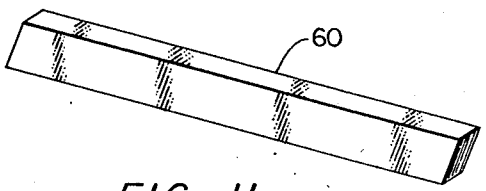
FIG. 11 is an isometric view of a key insert of the bit of FIG. 1.
Figure 10:
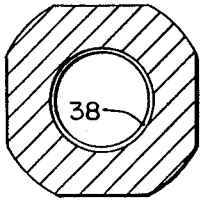
FIG. 10 is a transverse section view, in section, taken generally along line 10—10 of FIG. 1.

Referring now to the drawings in detail, wherein like numerals are used to designate the same or like parts, an impact bit assembly 10 incorparating a preferred embodiment of the present invention comprises an elongated male drive shank 12 and an enlarged female impact head 14 mounted on an outer end of the drive shank 12.

The male drive shank 12 had an anvil end face 16 at one end thereof for engagement by an impact piston (not shown) of a pneumatic downhole hammer (not shown) in a conventional manner. For example, the downhole hammer may be like that shown and described in U.S. Pat. No. 4,530,408, dated Jul. 23, 1985 and entitled "Porting System For Pneumatic Impact Hammer". Referring to that patent (which is incorporated herein by reference), the drive shank 12 is adapted to be mounted in one end of the downhole hammer so that an impact piston of the hammer can be pneumatically reciprocated to impact the anvil end face 16 at a high frequency for downhole impact drilling. The downhole hammer has a backhead at its other end for connecting the hammer to a drill string. Pneumatic pressure fluid under high pressure is conducted via the drill string to the hammer for pneumatic reciprocation of the impact piston. The pneumatic pressure fluid typically comprises compressed air at a high pressure of up to 350 psi or greater, to which is added a selected amount of lubricating oil and water coolant. The drill string is employed for rotating the downhole hammer and bit during drilling (normally at approximately 30 to 50 rpm) in the clockwise direction as viewed from outside the drilled hole. Also, the drill string is used for maintaining an inward force on the impact head 14 during drilling (which is typically approximately 2000 to 3000 pounds).

Referring further to U.S. Pat. No. 4,530,408, the drive shank 12 is axially shiftable within the downhole hammer between an outer blow position (shown in part in FIG. 6 of U.S. Pat. No. 4,530,408) and an inner drilling position (shown in FIG. 1B of U.S. Pat No. 4,530,408). In the outer blow position, the drive shank 12 is supported on bit retaining rings of the hammer and an externally threaded chuck screwed into the outer end of the hammer casing. In the inner drilling position, the impact head 14 and hammer chuck are in engagement. The chuck and bit drive shank 12 have respective internal and external, cooperating splines to provide a drive coupling for rotation of the drive shank with the hammer. In the shown embodiment, the shank drive coupling comprises eight equiangularly spaced, axially extending, parallel splines 20 on the drive shank 12. The bit 10 can be removed from the hammer by unscrewing the chuck from the hammer casing, removing the subassembly comprising the bit 10, chuck and retaining rings, and then removing the retaining rings and chuck from the drive shank 12.

Referring now the FIGS. 1 and 2, the eight shank drive coupling splines 20 on the drive shank 12 are machined on a slightly enlarged, generally central section of the drive shank 12. A cylindrical section 22 of the drive shank 12 is provided between those shank drive splines 20 and the slightly larger outer end of the drive shank 12 on which the female impact head 14 is mounted.

The female impact head 14 comprises a thick outer impact cap 24 for the outer impact end face 26 of the drive shank 12. The head also comprises an upstanding, integral collar 28 for receiving the outer end of the drive shank 12. The impact cap 24 has an inner impact face 30 (FIG. 4) conforming to the outer end face 26 of the drive shank 12 for efficient transmission of the impact force from the hammer impact piston through the drive shank 12 and cap 24. Preferably, the opposed impact faces 26, 30 of the two parts are designed as shown, flat and normal to the axis of the bit to facilitate machinability. In the alternative, the opposing impact faces 26, 30 may have a different conforming shape and/or the inner face 30 of the cap 24 may be provided by a separate intermediate impact transmitting member (not shown) designed to ensure efficient transmission of the impact force. Carbide buttons 34 are mounted within blind bores in the outer working face of the end cap 24 to provide hard surfaces for impact drilling.

The male drive shank 12 has a central axial through bore 36 providing an exhaust passage for the pneumatic impact hammer. That axial bore 36 has an enlarged opening 38 at its inner end for receiving a suitable exhaust tube (not shown, but disclosed in U.S. Pat. No. 4,530,408) and an enlarged oblong opening 40 at its outer end. The impact cap 24 has one or more through bores 42 with inner openings aligned with the outer opening 40 of the drive shank bore 36 to conduct the hammer exhaust to the outer working face 44 of the bit. The end cap bores 42 are inclined outwardly from their inlet end and the end cap 24 is suitably contoured for assiting in direnting the exhaust stream from the work area and for conducting rock and other particles away from the work area and out of the drilled hole with the high velocity exhaust stream.

In accordance with present invention, a new and improved coupling 50 is provided for mounting the female impact head 14 onto the outer end of the male drive shank 12. The coupling 50 is formed in part by machining cooperating impact head drive coupling splines 54, 56 within the internal surface of the collar 28 and on the slightly enlarged, outer end section of the drive shank 12. In each part, an annular arrangement of identical splines 54 or 56 and intermediate identical slots 55 or 57 is provided in which the slots have a circumferential width substantially greater than the respective splines 54 or 56. The splines 54, 56 extend primarily in the axial direction and in addition have a slight skew or inclination to the axis of the bit. Although the shown 20° angle of inclination is preferred, it is beleived that the angle can be reduced to 10° or less or increased to 30° or more. The splines 54, 56 for example could be skewed, flat straight splines (not shown) but preferably are machined as shown to extend helically and to provide helically extending shoulders 59. The spline shoulders 59 on the leading and trailing edges of the splines 54, 56 may be formed as shown with each shoulder surface radially aligned with the axis of the bit. In that event, the circumferential width of each internal spline 54 is greater at its root diameter than at its apex and each external spline 56 has an undercut and a greater circumferential width at its apex than at its root. In the alternative, the leading and trailing shoulders 59 of each splines 54, 56 may be parallel so that the splines are the same on both parts and have a constant tooth width as well as tooth pitch. In either case, the splines 54, 56 on both parts preferably have approximately the same width within a common diameter intermadiate their root and apex diameters. Also, the spline shoulders 59 are formed so that each pair of opposed spline shoulders 59 of the two assembled parts have closely mating surfaces.

Figure 8:
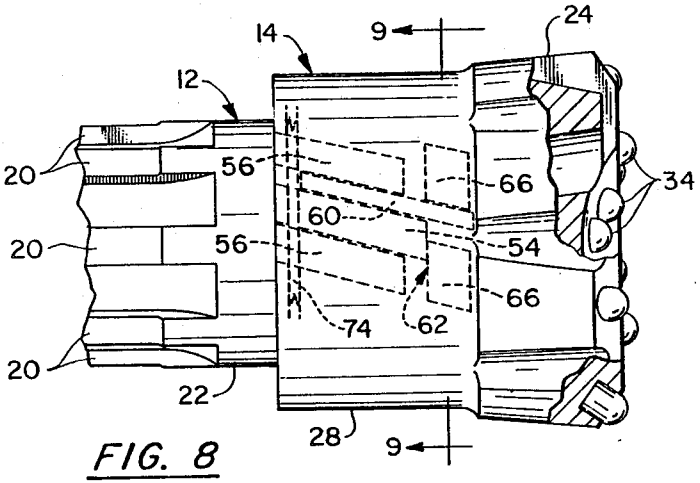
Figure 9:
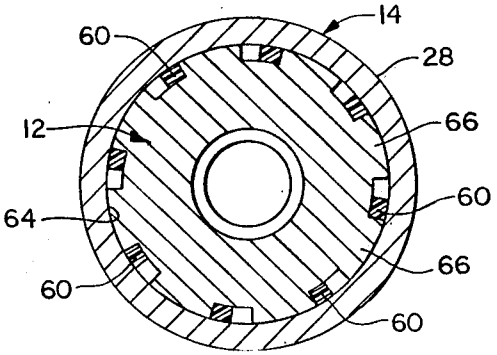
FIGS. 7 and 9 are transverse section views, in section, taken generally along lines 7—7 and 9—9 respectively of FIGS, 7 and 9.

The head drive coupling also comprises a plurality of elongated keys or inserts 60, one for pair of adjacent external and internal splines 54, 56 (and therefore a total of eight inserts 60 for the eight pairs of splines 54, 56 in the disclosed embodiment). After the head 14 is fully installed on the drive shank 12 with opposed shoulders 59 of the internal and external splines 54, 56 in mating engagement as shown in FIG. 8, the elongated keys 60 are individually inserted within the remaining narrow keyways or slots formed between the other opposed spline shoulders 59. The keys 60 preferably have edges or shoulders which closely conform to the shape of the spline shoulders 59. Also, the keys 60 preferably have a width which permits relatively easy insertion and removal of the keys 60 and yet which permits only very limited rotation (e.g., one or two degrees) of the head 14 on the drive shank 12. Accordingly, a relatively tight and yet readily easily assembled and disassembled head drive coupling is provided.

The head drive coupling is preferably configured as shown with the keys 60 mounted between the driving shoulders 59 of the external and internal splines 54, 56 (i.e., between the leading shoulders of the external splines 56 and trailing shoulders of the internal splines 54) and such that the head coupling drive torque is transmitted through the keys 60. In the alternative, the keys 60 could be mounted between the other opposed shoulders 59 of the splines 54, 56. Also, the keys 60 are preferably made of a suitable material having adequate lubricity and limited deformability that enables them to conform exactly to the mating shoulders of the drive coupling splines 54, 56 while at the same time transmit the required drive torque for rotation of the impact head 14 during drilling. Key inserts 60 made of oil annealed Delrin 150 have been found to have the desired phyical properties where the keys 60 are placed between the driving shoulders 59 to transmit the coupling torque.

In addition to the head drive coupling described, a head lock 62 is provided for locking the head 14 on the drive shank 12 against axial withdrawal. The lock 62 comprises an annulus 64 in one of the parts and a circuit arrangement of equiangularly spaced, circumferentially extending locking lugs 66 on the other part. The annulus 64 and circular arrangement of lugs 66 are axially located so that the lugs 66 are received within the annulus 64 when the head 14 is axially inserted on the drive shank 12. In the preferred embodiment shown, the internal annulus 64 is provided within the collar 28 and the circular arrangement of external lugs 66 is provided on the drive shank 12.

The internal locking annulus 64 is machined within the collar 28 between the inner ends of the internal splines 64 and the inner impact face 30 of the impact cap 24. The annulus 64 has a diameter slightly greater than the diameter of the slots 55 machined between the internal splines 54. In the shown embodiment, the annulus 64 is machined to form open inner, abutment end faces 70 on the splines 54 which are tapered inwardly at an angle of 60° to the bit axis.

Figure 6:
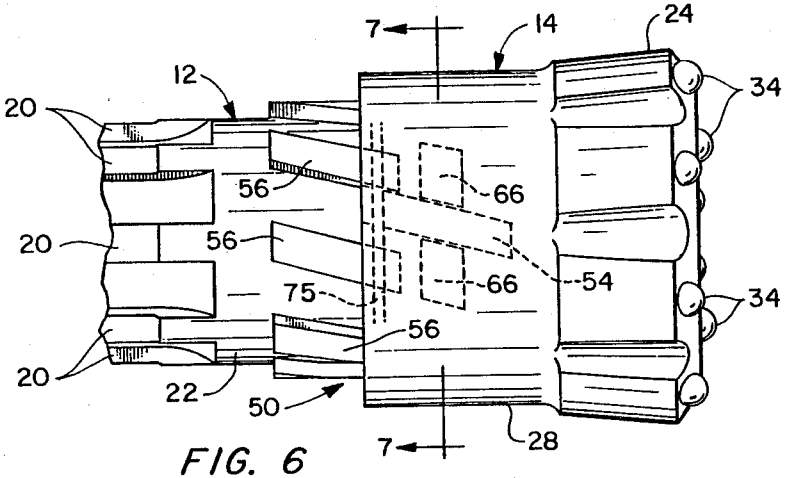
Figure 7:
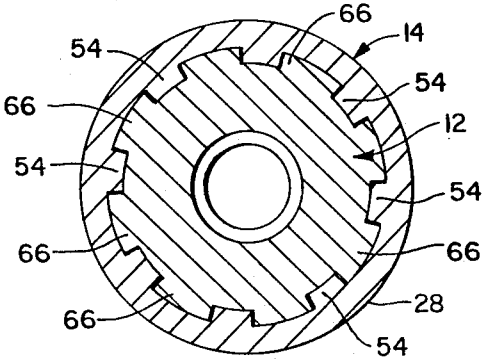

The circular arrangement of lugs 66 are provided on the drive shank 12 between the splines 56 and impact end face 26. The lugs 66 extend circumferentially across part of the slot openings 57 between adjacent external splines 56 and such that as shown in FIG. 6, the circumferential width of the remaining slot opening is just wide enough to freely receive the internal splines 54 of the head 14. After the head 14 is fully inserted on the drive shank 12, it is rotated slightly (in the shown embodiment, in the drive or counterclockwise direction as viewed from the outer end of the bit) to rotate the internal splines 54 into engagement with the external splines 56 and thus to position the internal splines 54 in axial alignment with the locking lugs 66. The keys 60 are then inserted to maintain the drive coupling splines 54, 56 in that locking position in which the inner open end faces 70 of the internal splines 54 provide abutment faces engageable by the opposed shoulders of the lugs 66 to lock the head against axial withdrawal. Those opposed surfaces are machined to provide closely mating surfaces and a maximum axial end play of 0.010 in between the parts. Accordingly, the cooperating impart faces 26, 30 are maintained in close abutting association.

With the drive splines 54, 56 skewed as described, rotation of the bit during drilling continuously forces the head 14 and drive shank 12 together to ensure continuous engagement by their opposed impact faces 26, 30 and thus efficient transmission of the impact force through the head. That is so notwithstanding the high frequency and large impact force transmitted.

The external grooves 57 machined on the drive shank 12 and the internal grooves 55 and annulus 64 machined on the impact head 14 cooperate so that the head 14 can be readily installed on the shank 12 with a sliding fit. The head is installed by (a) aligning the internal splines 54 of the head 14 with the narrow slot openings at the outer end of the shank 12, (b) inserting the head 14 axially onto the shank 12 until the internal face 30 of the impact cap 24 engages the outer end face 26 of the shank 12 and (c) then rotating the head 14 on the shank 12. The keys 60 are then inserted to hold the parts against rotation. Finally, a snap-ring 74 is mounted within an internal annulus 75 in the outer end of the collar 28 to retain the keys 60 against inadvertent withdrawal. The impact head 14 can be readily removed from the drive shank 12 for repair and replacement of either part by reversing that procedure.

As will be apparent to persons skilled in the art, various modifications, adaptations and variations of the foregoing specific disclosure can be made without departing from the teachings of the present invention.

I claim:

1. For use in a downhole impact drill having an elongated pneumatic impact hammer with an impact bit at one end thereof and a backhead at the other end thereof for coupling the downhole hammer to a drill string used to supply air under pressure for pneumatic operation of the hammer and to urge the hammer inwardly and rotate the hammer in one angular direction during downhole drilling, the impact bit having a drive shank with an anvil end face at one end thereof, and the hammer having an impact piston pneumatically reciprocable to impact the anvil end face at a high frequency for downhole impact drilling, an impact bit for a downhole hammer comprising an assembly of an elongated male drive shank having external, shank drive splines for rotation of the drive shank by the hammer in said one angular direction during drilling, a said anvil end face at one end thereof and an impact end face at the opposite end thereof and an enlarged female impact head mounted on said opposite end of the drive shank and engageable by the downhole hammer to be urged inwardly thereby during drilling, the impact head having an impact cap with an inner impact face engageable by the impact end face of the drive shank and an upstanding collar for receiving said opposite end of the drive shank, the drive shank and upstanding collar having cooperating annular arrangements of equiangularly spaced, external and internal, head drive splines respectively, extending generally helically away from the respective impact faces in an angular direction opposite to said one angular direction to urge said opposing impact faces into engagement by rotation of the drive shank in said one angular direction during drilling, the collar having an internal annulus and the drive shank having a circular arrangement of locking lugs received within the annulus, the drive shank lugs cooperating with the collar for locking the head against axial withdrawal from the drive shank in one relative angular position thereof, the circumferential width and spacing of the head drive splines permitting the head to be axially inserted on the shank and then rotated to said one relative angular position, the bit assembly further comprising elongated key inserts between the enternal and internal, head drive splines to form therewith a drive coupling for rotation of the impact head by the drive shank, the key inserts being inserted between the splines in said one relative angular position of the head and shank and preventing relative rotation of the head and shank therefrom.

2. An impact bit according to claim 1, wherein the key inserts are made of plastic.

3. An impact bit according to claim 1, wherein the impact head is a single, integrally formed part.

4. An impact bit according to claim 1, wherein said annular arrangement of external, head drive splines of said drive shank are adjacent to but axially spaced from said impact end face and wherein the drive shank comprises a cylindrical section intermediate said annular arrangement of external, head drive splines and said external, shank drive splines.

5. An impact bit assembly comprising an elongated male drive shank having an anvil end face at one end thereof and an impact end face at the opposite end thereof and an enlarged female impact head mounted on said opposite end of the drive shank, the impact head having an impact cap with an inner impact face engageable by the impact end face of the drive shank and an upstanding collar for receiving said opposite end of the drive shank, the drive shank and upstanding collar having cooperating annular arrangements of angularly spaced external and internal, head drive splines respectively, angularly skewed from the bit axis in one angular direction away from the respective impact faces to maintain the impact faces of the shank and end cap in engagement during rotation of the drive shank in the opposite angular direction during drilling, the impact head having an internal annulus and the drive shank having a circular arrangement of lugs received within the annulus, the drive shank lugs cooperating with the collar for locking the head against axial withdrawal from the drive shank in a first relative angular position thereof, the circumferential width and spacing of the head drive splines permitting the head to be axially inserted on the shank and then rotated to said first relative angular position, the bit assembly further comprising elongated key inserts between the external and internal, head drive splines to form therewith a drive coupling for rotation of the impact head by the drive shank, the keys being inserted between the internal and external, head drive splines in said first relative angular position of the head and shank and preventing relative rotation of the head and shank therefrom.

6. An impact bit assembly according to claim 5 wherein the key inserts are mounted between the internal and external, head drive splines on the leading side of the external, head drive splines and trailing side of the internal, head drive splines to transmit torque from the drive shank to the impact head through the key inserts for rotation of the impact head by the drive shank in said opposite angular direction during drilling.

7. An impact bit assembly according to claim 5 wherein said annular arrangements of external and internal, head drive splines are skewed from the bit axis at an angle of between 10° to 30°.

8. An impact bit assembly according to claim 7 where the skew angle is approximately 20°.

9. An impact bit assembly according to claim 5 wherein the key inserts are made of plastic having lubricity and limited deformability.

10. An impact bit assembly comprising an elongated male drive shank having an anvil end face at one end thereof and an impact end face at the opposite end thereof and a female impact head mounted on said opposite end of the drive shank, the impact head having an impact cap with an inner impact face engageable by the impact end face of the drive shank and an upstanding collar for receiving said opposite end of the drive shank, the drive shank and upstanding collar having cooperating annular arrangements of angularly spaced external and internal, head drive splines respectively, angularly skewed from the bit axis in one angular direction away from the respective impact faces to urge said impact faces into engagement during rotation of the drive shank in the opposite angular direction during drilling, the bit assembly further comprising locking means for locking the head the circumferential width and spacing of the head drive splines permitting the head to be axially inserted on the shank the then rotated to said first relative angular position thereof, the bit assembly further comprising elongated keys inserted between the external and internal, head against axial withdrawl from the drive shank in a first relative angular position thereof, drive splines to form therewith a drive coupling for rotation of the impact bit by the drive shank, the keys being inserted between the internal and external, head drive splines in said first relative angular position of the head and shank and preventing rotation of the head on said drive shank therefrom.

11. An impact bit assembly according to claim 10, wherein the head drive splines are skewed in said one angular direction from the axis of the bit at an angle of between 10° to 30°.

12. An impact bit assembly according to claim 11, wherein the head drive splines are skewed in said one angular direction from the axis of the bit at an angle of approximately 20°.

13. An impact bit assembly according to claim 10, wherein the impact head is a single, integrally formed part.

14. An impact bit assembly according to claim 10, wherein said external, head drive splines of the drive shank are adjacent to but axially spaced from said impact end face, and wherein the drive shank comprises an annular arrangement of external, shank drive splines between said external, head drive splines and said anvil end face and a cylindrical section intermediate said external, head drive splines and said external, shank drive splines.

15. For use in an impact bit assembly having an elongated male drive shank with an anvil end face at one end thereof and an impact end face at the opposite end thereof, a rotary impact head subassembly comprising a female impact head adapted to be mounted on said opposite end of the drive shank and a plurality of elongated keys, the female impact head having an impact cap with an inner impact face facing in one axial direction for engagement by the impact end face of the drive shank and an upstanding collar extending in said one axial direction for receiving said opposite end of the drive shank, the upstanding collar having an annular arrangement of angularly spaced internal, head drive splines skewed from the bit axis in one angular direction away from the inner impact face to urge the impact head and therefore its inner impact face towards the drive shank during rotation of the impact bit by the drive shank in the opposite angular direction, the elongated keys being adapted to be inserted between the internal, head drive splines to form therewith, part of a drive coupling for rotation of the impart head by the drive shank, the circumferential width and spacing of the internal, head drive splines providing for axially inserting the head on the drive shank and then rotated to a first relative angular position thereon, the keys being inserted between the internal, head drive splines in said first relative angular position and operable for preventing disengagement of the head drive coupling.

16. An impact head subassembly according to claim 15, wherein the internal, head drive splines extend helically in said one angular direction away from said inner impact face at an angle of between 10° to 30°.

17. A rotary, impact bit head for an impact bit assembly having an elongated male drive shank with an anvil end face at one end thereof and an impact end face at the opposite end thereof, and an annular arrangement of head drive splines at the impact end thereof, the impact bit head comprising an impact cap with an inner impact face facing in one axial direction and a working face facing in the opposite axial direction and an annular, upstanding head mounting collar extending in said one axial direction from the impact cap for receiving the impact end of the male drive shank, the collar having an annular arrangement of angularly spaced, axially extending, internal, drive splines for rotating the head with the external splines of the drive shank and skewed from the axis of the bit head in one angular direction away from the inner impact face to urge the impact head in said one axial direction during rotation of the bit head through the internal, head drive splines in the opposite angular direction.

18. A rotary, impact bit head according to claim 17, wherein the internal, head drive splines are skewed in said one angular direction from the axis of the bit head at an angle of between 10° to 30°.

19. A rotary, impact bit head according to claim 18, wherein the internal, head drive splines are skewed in said one angular direction from the axis of the bit head at an angle of approximately 20°.

20. A rotary, impact bit head according to claim 17, wherein the internal, head drive splines extend helically in said one angular direction.

21. A rotary, impact bit head according to claim 17 for use with a rotary impact bit drive shank having a circular arrangement of locking lugs, wherein the collar further comprises an internal locking annulus for receiving the circular arrangement of locking lugs for cooperation therewith for locking the head onto the drive shank in one relative angular position thereof.

22. A rotary impact bit drive shank with an anvil end face at one end thereof and an impact end face at the opposite end thereof, a first annular arrangement of a plurality of equiangularly spaced external, shank drive splines intermediate the ends thereof, a second annular arrangement of a plurality of equiangularly spaced external, impact head drive splines at said opposite end thereof, a circular arrangement of angularly spaced, external, impact head locking lugs and an intermediate generally cylindrical section intermediate said first and second annular arrangements of external splines.

* * * * *

UNITED STATES PATENT AND TRADEMARK OFFICE

CERTIFICATE OF CORRECTION

PATENT NO. : 4,919,221

DATED : April 24, 1990

INVENTOR(S) : Jack H. Pascale

It is certified that error appears in the above-identified patent and that said Letters Patent is hereby corrected as shown below:

Column 1, line 13, substitute -- principal -- for "prinical".

Column 1, line 62, substitute -- FIGS. 6 & 8 -- for "FIG, 6 & 8", which should start a new paragraph.

Column 2, line 63, substitute -- to -- for "the" (first occurrence)

Column 3, line 34, substitute -- directing -- for "direnting".

Column 3, line 38, before "present" insert -- the --.

Column 4, line 2, substitute -- intermediate -- for "intermadiate"

Column 4, line 8, after "for" insert -- each --.

Column 4, line 48, substitute -- circular -- for "circuit".

Column 5, line 20, substitute -- impact -- for "impart".

Claim 10, line 17, after "head" insert -- against axial withdrawal from the drive shank in a first relative angular position thereof, --.

Claim 10, line 19, delete "the" (second occurrence) and insert -- and --.

UNITED STATES PATENT AND TRADEMARK OFFICE

CERTIFICATE OF CORRECTION

PATENT NO. : 4,919,221

DATED : April 24, 1990

INVENTOR(S) : Jack H. Pascale

It is certified that error appears in the above-identified patent and that said Letters Patent is hereby corrected as shown below:

Claim 10, line 22, after "head", delete "against axial withdrawal from the drive shank in a first angular position thereof,".

Signed and Sealed this

Seventh Day of January, 1992

*Attest:*

HARRY F. MANBECK, JR.

*Attesting Officer*

*Commissioner of Patents and Trademarks*